US008210455B2

(12) United States Patent
Newbold et al.

(10) Patent No.: US 8,210,455 B2
(45) Date of Patent: Jul. 3, 2012

(54) DEEP DRAWN NOZZLE FOR PRECISION LIQUID DISPENSING

(75) Inventors: John D. Newbold, Carslbad, CA (US); Brian L. Verilli, Carsbad, CA (US)

(73) Assignee: Brian L. Verrilli, Carlsbad, CA (US)

( * ) Notice: Subject to any disclaimer, the term of this patent is extended or adjusted under 35 U.S.C. 154(b) by 0 days.

(21) Appl. No.: 09/828,621

(22) Filed: Apr. 6, 2001

(65) Prior Publication Data

US 2002/0145061 A1 Oct. 10, 2002

(51) Int. Cl.
*B05B 1/00* (2006.01)

(52) U.S. Cl. .... 239/589; 239/600; 239/601; 29/890.142

(58) Field of Classification Search ..... 239/589, 239/591, 600, 601; 222/567, 570; 29/890.14, 29/890.12, 890.132, 890.142
See application file for complete search history.

(56) References Cited

U.S. PATENT DOCUMENTS

| | | | | |
|---|---|---|---|---|
| 3,419,220 | A * | 12/1968 | Goodwin et al. | 239/591 |
| 4,161,280 | A * | 7/1979 | Kasinskas | 239/589 |
| 4,421,722 | A * | 12/1983 | Massey et al. | 239/600 |
| 5,104,013 | A * | 4/1992 | Hawley | 239/600 |
| 6,186,422 | B1 * | 2/2001 | Hubner et al. | 239/589 |
| 2001/0032887 | A1 * | 10/2001 | Everett | 239/589 |

* cited by examiner

*Primary Examiner* — Steven J Ganey

(57) ABSTRACT

A nozzle for delivering a measured quantity of viscous liquid including a flared opening defined by a horizontal perimeter and a flare wall extending inward from the perimeter, a cylindrically-shaped barrel wall extending from the flare wall downward to a break point defined by a circle parallel to the flare opening and spaced-apart therefrom, a cone-shaped wall extending downward from the circular break point and inward therefrom to a circular exit opening, and a small-diameter exit tube extending from the circular exit opening to a circular exit aperture.

19 Claims, 2 Drawing Sheets

DEEP DRAWN NOZZLE FOR PRECISION LIQUID DISPENSING

FIELD OF THE INVENTION

This invention pertains to the field of liquid dispensing equipment. More particularly, it pertains to a novel nozzle that directs precise volumes of viscous curable and non-curable liquids into locations that require precise injection of these liquids such as in the computer circuit industry.

DESCRIPTION OF THE PRIOR ART

As the computer industry strives for more and more capability and, simultaneously, seeks to make computers smaller and more compact, the computer components, such as computer chips (known as "devices") fastened to the carrier are being crowded closer and closer together. This crowding has spawned newer techniques for mounting the devices on the carrier, such as a circuit board or on a computer chip, and attaching the electronic connections extending from these devices to those in the carrier.

In the practice of attaching computer circuit components to carriers, currently, the practice is to arrange the component connections underneath the component and to terminate them with small spheres or bumps that extend underneath the component soldered to minute pads formed on the carrier surface. The component often becomes hot during its use in the computer circuit and this heat causes the chip to expand thereby causing stress in the solder joints. In addition, the computer is often of the portable variety where it may be dropped or otherwise subjected to physical shock thus placing an even greater stress on the solder joints.

A practice has arisen where the space between the component or electronic device and the carrier is filled with a polymeric substance. This is called "underfilling" and finds extensive use in situations where components are soldered to printed circuit boards and to flip chips, the latter being computer chips that are soldered to the top of BGA packages and/or to printed circuit boards. The underfill serves several purposes. It compensates for the differences in coefficient of thermal expansion between the silicon chip and the carrier. It reduces the stress on the solder bumps caused by mechanical shock. By completely surrounding each solder bump, underfill holds each bump in hydrostatic compression and effectively prevents the solder from creeping, as it would do if there were an adjacent open space. Underfill also aids in the dissipation of heat generated during computer operation. The underfill is done mostly using a curable liquid adhesive such as an epoxy resin.

The adhesive is presented as a viscous liquid, sometimes containing a filler, that is often heated to reduce viscosity and carefully dispensed through a nozzle along one side or multiple sides of the device and allowed to wick throughout the remainder of the space under the device by capillary action. It thereafter hardens through a curing process which results in a strong, adhesive bond between the device and the carrier or substrate. This strong bond also surrounds each of the bumps in the device and aids in resisting fractures of the soldered connections when the assembly is subjected to shock, heat and cold.

While the microchip, with heated liquid adhesive, seemed to be the answer to the problem, a new problem developed, namely how to design an economical nozzle to apply the viscous liquid onto the device. The criteria needed in a good dispensing nozzle is to have an inside design that reduces the pressure required to force the viscous liquid out of the nozzle and to the assembly. Further, the nozzle must have good heat transfer characteristics so that it can easily transfer heat from the outside to lower the viscosity of the liquid. The nozzle needs to be dimensionally stable under pressure so that each injection of the liquid is of a predictable volume where not too much liquid is injected, resulting in overfilling and running into areas where its presence is detrimental, or not too little liquid is injected, resulting in underfilling the device thereby reducing the inherent benefits of the liquid. The nozzle needs to have a short straight section at the tip so that the liquid can be accurately dispensed onto the assembly. The walls of the nozzle need to be thin for many reasons. A thinner wall enables the liquid to be closer to the device for such reasons as enhancing the initial wicking action and lowering the resistance of the tip. Thinner walls also provide less facial area at the base upon which liquid can adhere resulting in a cleaner breakoff of the dispensed liquid. The thinner wall also results in the smallest difference between the surface area on the exterior, as opposed to the interior. This provides less surface tension forces which direct the fluid to accumulate on the exterior of the nozzle. Thus more liquid is held on the interior of the nozzle improving both speed and accuracy of dispensing and of the automated dispensing equipment upon which it may be used. Additionally, the material making up the nozzle must have good heat transfer characteristics. This enables reduction of viscosity in most liquids, thereby enhancing the dispensability of the liquid. Further, the thinner wall also enables a more uniform and rapid thermal response to the entire nozzle body. Finally, thinner walls enable dispensing on densely populated circuitry.

At present there are three general types of nozzles used to underfill these devices with viscous liquid: (1) a modified hypodermic needle made of stainless steel and medical tubing, (2) a custom machined metal nozzle, and (3) a molded plastic cone-shaped nozzle. The modified hypodermic needle nozzle is merely a standard hypodermic needle adapted to be fitted to a standard valve (Luer or Luer lock type) and attached to a hose leading from a pump that is connected to a reservoir of liquid. The problem with modified hypodermic needles is that a constant diameter throughout the length of the needle causes a very high pressure drop across the needle and restricts liquid flow. In addition, the needle is made from stainless steel, plastic, or brass. Stainless steel and plastic are not known as a good heat transfer materials.

The custom machined nozzle may be made of better heat transfer materials and may be shaped to remove or, at least, greatly reduce the resistance produced in the hypodermic needle design. However, a machined nozzle is limited to the size of the tools that can be used to cut the inside wall diameter. This limitation, along with the high cost of machining minute nozzles of this type, has slowed the widespread use of such nozzles in the industry. The molded plastic nozzle can be made in a variety of sizes and shapes; however, because plastics are not good heat transfer agents nor dimensionally stable, such a practice has not been well accepted in the industry and the modified hypodermic needle remains the most widely used nozzle.

The inventors have found, through testing, modeling, and observing a wide variety of underfilling devices, that certain characteristics spell the difference between success and failure with underfilling nozzles. These characteristics include the relationship between the length of the tip of the nozzle to the thickness of the nozzle walls at the tip along with the rate of convergence of the delivery tube to the upper end of the nozzle. By maintaining these relationships within a relatively narrow range, very effective dispensing of the viscous epoxy liquids can be made to a wide variety of mounted devices.

SUMMARY OF THE INVENTION

This invention is a metal nozzle, containing a high percentage of copper, having an internal and external smooth and very thin wall, for delivering a measured quantity of viscous liquid, generally in a heated condition and injecting it next to the narrow underspace of a micro-chip device solder-mounted on a carrier board wherein the nozzle comprises an upper flared opening, defined by a horizontal perimeter, and a flare wall extending inward from the perimeter, a cylindrically-shaped barrel wall extending from the flare wall downward to a break point defined by a circle parallel to the flare opening and spaced-apart therefrom, a cone-shaped wall extending downward from the circular break point and inward therefrom to a circular exit opening at a rate of convergence lying between 5° and 20°, and more particularly 10°, and a small-diameter exit tube extending from the circular exit opening, at one end of the tube, to a circular exit aperture, at the other, spaced-apart end of the tube where the ratio between the inside diameter of the exit tube to the wall thickness of the exit tube is at least 7.5 and preferably larger. The flared opening is arranged to fit into a Luer connection or other connection. The Luer connection is connected in turn to a first hose that is connected to a transfer hose that is connected to a pump and to a reservoir of the liquid epoxy. Heating coils are arranged near or around the nozzle to allow final heating of the liquid, to reduce its viscosity and allow it to be more easily and accurately applied next to the underspace without requiring a significant amount of pump power.

The invention also includes a novel method of making such a nozzle for delivering a measured quantity of viscous liquid into minute spaces comprising the steps of placing a small circular tablet of a thermally conductive, malleable metal on a circular die having a cylindrically extended inner wall, advancing a conically-shaped mandrel against the center of the tablet and forcing the metal to be drawn down into the die and along the cylindrically extending inner wall, and repeating these steps using progressively smaller-diameter, conically-shaped mandrels and progressively smaller diameter, circular dies, each having cylindrically extending inner walls, until a thin-walled nozzle is formed comprising an upper flared opening defined by a horizontal perimeter and a flare wall extending horizontally inward from the perimeter, a cylindrically-shaped barrel wall extending from the flare wall downward to a break point defined by a circle parallel to the flare opening and spaced-apart therefrom, a cone-shaped wall extending downward from the circular break point and inward therefrom to a circular exit opening, and a small-diameter exit tube extending from a circular exit opening, at one end of the tube, to a circular exit aperture, located at the other end of the tube.

Accordingly, the main object of this invention is a novel nozzle that allows a large amount of heat transfer in a short amount of time to lower the viscosity of the dispensable liquid. Other objects of the invention include a low cost nozzle having a short, wide, transfer barrel for transferring the liquid from the first hose to the point of dispense; a nozzle that has a wide barrel and a conical entry spout to lower the required pump pressure of the adhesive; a nozzle with a very short run of small diameter tubing to reduce the pressure drop of the liquid over the length of the nozzle; a nozzle with a low, smooth-walled interior profile that does not accumulate unwanted buildup on the tip nor allow the liquid to hang up in the barrel; a nozzle with a thin wall able to dispense liquid close to the device; and, a nozzle made with a low cost process that allows the nozzles to be made more economically and more useful in the relevant industry.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE PREFERRED EMBODIMENT

Figure 1:
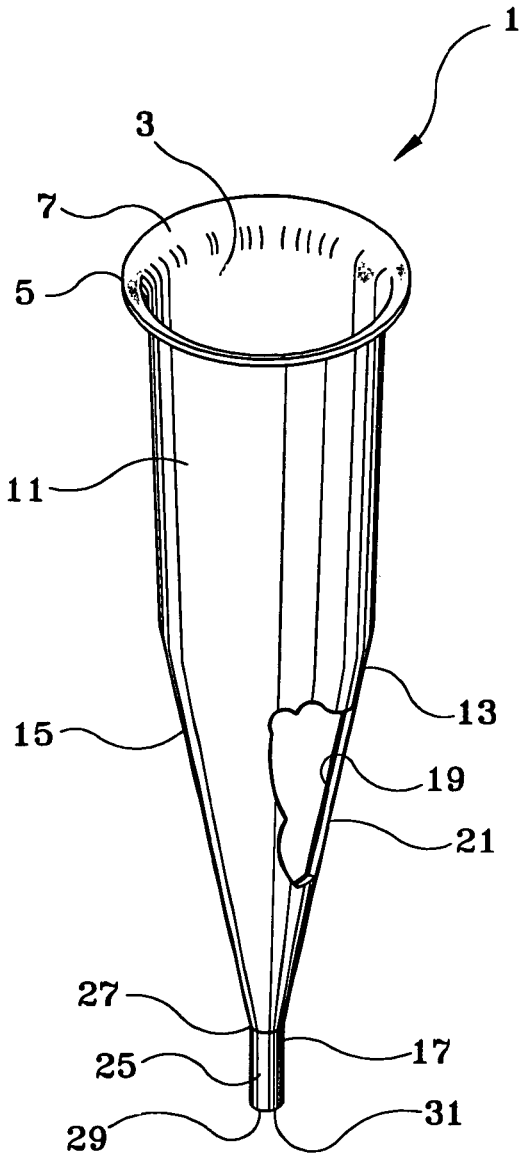
FIG. 1 is a prospective view of the preferred embodiment of the nozzle of this invention.
Figure 2:
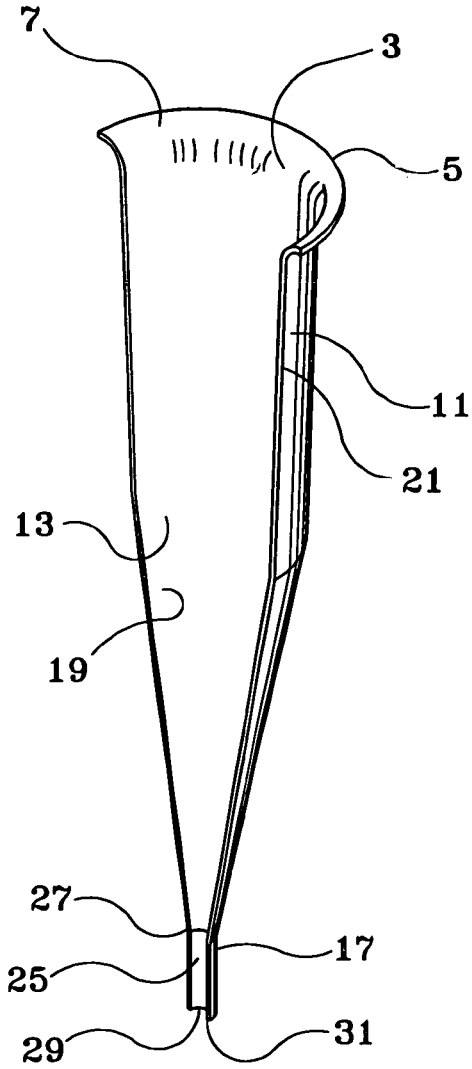
FIG. 2 is a prospective cut-away view of the embodiment shown in FIG. 1.
Figure 3:
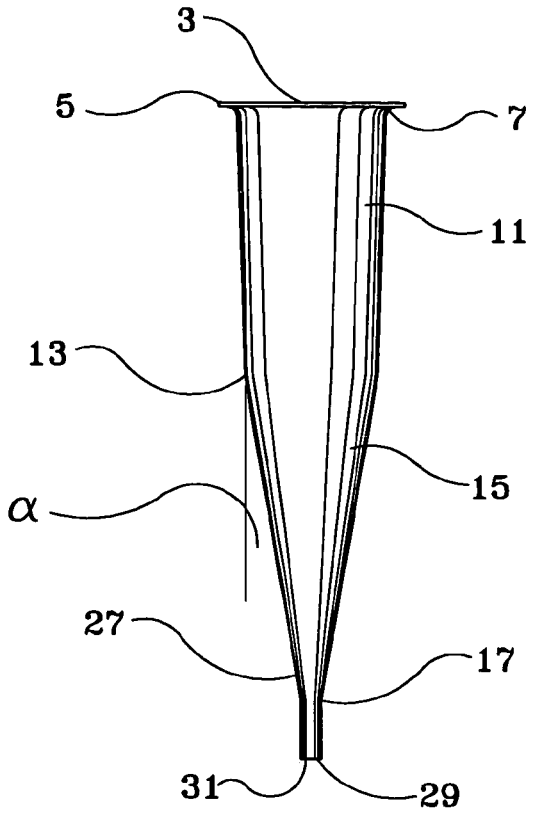
FIG. 3 is a side elevation view of the embodiment shown in FIG. 1.
Figure 4:
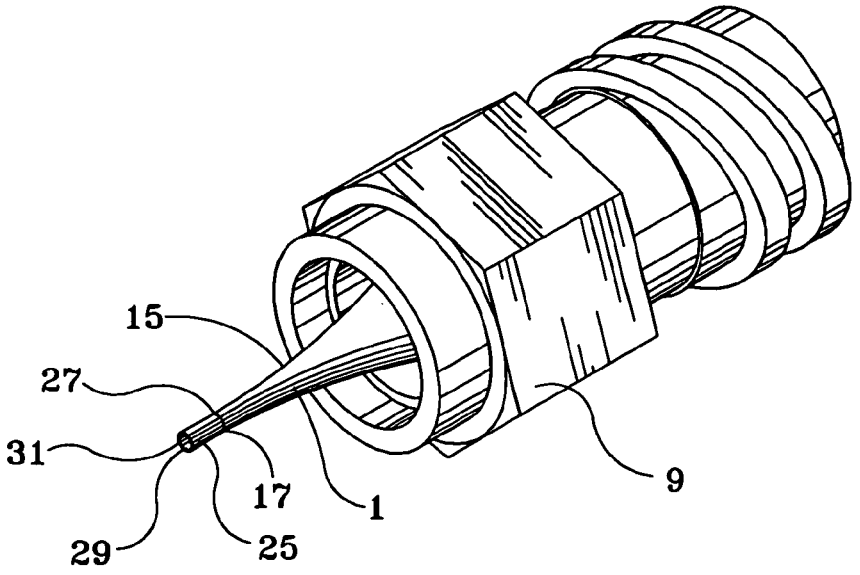
FIG. 4 is a prospective view of the nozzle mounted in a Luer lock retention device.

Turning now to the drawings wherein elements are identified by numbers and like elements are identified by like numbers throughout the four figures, the inventive nozzle 1 is depicted in FIG. 4 in a horizontal attitude, in FIGS. 1-3, the inventive nozzle 1 is depicted in vertical or near-vertical attitude, and comprises an upper flared opening 3 defined by a horizontally arranged perimeter 5 and a flare wall 7, extending there between, inward from perimeter 5. The purpose of upper flared opening 3 is to enter into a leak-proof connection with a retention device 9, partially shown in FIG. 4, which usually joins to a valve for controlling the flow of liquid through nozzle 1.

A cylindrically-shaped barrel wall 11 extends from flare wall 7 downward to a break point defined by a circle 13 preferably arranged parallel to upper flared opening 3 and spaced-apart therefrom. Barrel wall 11 is made with a slight inward slant or cast, such as between 1° to 5° and more preferably about 2° which provides a leakproof connection to the Luer.

A cone-shaped wall 15 extends from around circular break point circle 13 downward and inward therefrom to a circular exit opening 17. Cone-shaped wall 15 is preferably made with a smooth interior wall surface 19 and a smooth exterior wall surface 21. Interior wall surface 19 presents less resistance to the flow of viscous liquid than a non-smooth wall. The inward slant of cone-shaped wall 15 is variable; however, tests have shown that a slant of 5° to 20° and more preferably about 10° provides the most desirable reduction in resistance to flow transition.

A small-diameter exit tube 25 extends from a first end 27, in sealing arrangement with, or monolithic extension of, circular exit opening 17, downward to a second end 29, forming a circular exit aperture 31, from which the viscous liquid will issue for dispensing next to a previously solder-mounted device. The length of exit tube 25 may be varied to accommodate different devices and different environments. In addition, first end 27 may not be clearly discernable as cone shaped wall 15 may form first tube end 27 in a smooth, yet rather abrupt, transition covering a short length of tube 25.

In the preferred embodiment of the invention, it is preferred that nozzle 1 be made of a metal comprising a large percentage of a thermally conductive material, such as copper. More particularly, it is preferred that the thermally conductive material, such as copper, comprises at least 90% by weight of the metal. It is further preferred that opening 3 be made circular and the horizontal perimeter 5 be limited to about 25 mm in diameter. Flared wall 7, that extends inward from perimeter 5, is preferably set at about 5 mm in width. Cylindrically-shaped barrel wall 11 preferably extends downward from flared wall 7 about 30 mm. Cylindrically-shaped barrel wall 11, that extends downward from flared wall 7, is preferably set at an angle of about 2° with the vertical. Cone-shaped wall 15 preferably extends downward from circular break point 13 about 40 mm. It is also preferred that cone-shaped wall 15 extends downward from circular break point 13 at an angle of about 15° with the vertical. Circular exit opening 17 should have an opening of about 1.5 mm. Small-diameter exit tube 25, extending from circular exit opening 17, should extend about 2 mm and, it is further preferred that the diameter of tube 25 be constant from first end 27 to second end 29. In other cases, it is preferred that flair wall 7 has a diameter of between about 1.05 to about 1.15 diameters of planar circular surface break point 13.

It is preferred that the wall thickness of nozzle 1 be held as constant as possible throughout the manufacturing process as possible. Wall thicknesses on the order of 0.005 inches have proven to be acceptable as well as thicknesses slightly thicker and slightly thinner. Short barrel wall 11 and short cone-shaped wall 15 contribute to a great reduction in overall pressure drop from that experienced with the modified hypodermic needle of the prior art. In addition, the high percentage of thermally conductive material, such as copper, contributes to improved heating and cooling rates and quicker pass-through of the liquid in the nozzle. The conical shape creates a condition of increased surface area compared to the prior art, exposing more liquid to the thermal source. Where the barrel wall and/or the cone-shaped wall are extended for some operations, such extension do not degrade performance of the nozzle because the high percentage of thermally conductive material in the nozzle improves exterior heating of the nozzle with improved heat transfer into the liquid. It is preferred that the nozzle be made in one, monolithic unit so that the possibility of crevices which could trap air or restrict flow is eliminated and that assembly is kept to a minimum.

The relationship between the internal diameter of exit tube 25 and the wall thickness of exit tube 25 is important, as is the degree of convergence or angle of inward slanting of cone-shaped wall 15. It has been found that, to achieve the objects of this invention, the ratio of the internal diameter of exit tube 25 to the wall thickness of exit tube 25 should be greater than 7.5 and, in addition, the degree of convergence, shown as angle "alpha", in FIG. 3, should be in the range of 5° to 20° and more preferably about 10°.

The preceding features of the embodiment are important aspects of the deep drawn nozzle 1 because its design is dependant upon the novel method used to produce it. Such a method is known as deep drawing and is accomplished through deformation of a small circular tablet of malleable, thermally conductive, material containing a high percentage of copper into the desired shape by a press or other such device as is known in the prior art to produce the deep drawn metal nozzle 1. Forcing the metal into a series of progressively smaller diameter circular die using conically shaped mandrels accomplishes this; each die having deeper and narrower cylindrical inner walls forces the material to deform in a successive manner until the finished thin-walled deep drawn nozzle 1 is formed.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A thin-walled nozzle for delivering a measured quantity of viscous liquid comprising:

a) an opening defined by a perimeter and surrounded by a cylindrically-shaped barrel wall extending from said perimeter downward to a break point defined by a circle coincident to interior of said cylindrically-shaped barrel wall spaced-apart from said opening;

b) a means for connecting said cylindrically-shaped barrel wall of said thin-walled nozzle to a reservoir from which said measured quantity of viscous liquid is transferable to said thin-walled nozzle;

c) a cone-shaped wall extending downward from said break point defined by a circle and then inward there from to a circular exit opening coincident to inside diameter of said cone-shaped wall; and, d) a straight, small-diameter exit tube, of uniform inside diameter, extending from said circular exit opening to a circular exit aperture of constant inside diameter for dispensing said measured quantity of viscous liquid from said thin-walled nozzle;

e) wherein there is a controlled ratio of wall thickness of said small-diameter exit tube in relation to inside diameter of said small-diameter exit tube.

2. The thin-walled nozzle for delivering a measured quantity of viscous liquid of claim 1 wherein the ratio of wall thickness of said small-diameter exit tube in relation to inside diameter of said small-diameter exit tube exceeds 7.5.

3. The thin-walled nozzle for delivering a measured quantity of viscous liquid of claim 1 wherein said opening is circular and said perimeter is horizontal and about 25 mm in diameter.

4. The thin-walled nozzle for delivering a measured quantity of viscous liquid of claim 1 wherein said cone-shaped wall extending downward from said break point defined by a circle and then inward there from to said circular exit opening has a wall convergence between about 5° and about 20°.

5. The thin-walled nozzle for delivering a measured quantity of viscous liquid of claim 1 wherein a flare wall extends outward from said perimeter about 5 mm.

6. The thin-walled nozzle for delivering a measured quantity of viscous liquid of claim 1 wherein said cylindrically-shaped barrel wall extends downward from said perimeter at an angle of about 2° with the vertical thereby providing a leak-proof connection to a Luer.

7. The thin-walled nozzle for delivering a measured quantity of viscous liquid of claim 1 wherein said thin-walled nozzle is a monolithic metal structure whereby a reduced propensity for said liquid to hang up, clog or trap pockets of air is achieved.

8. The thin-walled nozzle for delivering a measured quantity of viscous liquid of claim 1 wherein said thin-walled nozzle is made from a metal with a high percentage of thermally conductive material.

9. The thin-walled nozzle for delivering a measured quantity of viscous liquid of claim 1 wherein said thin-walled nozzle is made of an alloy composed of around ninety percent copper.

10. A thin-walled deep drawn nozzle for delivering a measured quantity of viscous liquid comprising:

a) a flared opening inside all around and delimited by a perimeter that is on a plane perpendicular to a vertical axis;

b) a cylindrically-shaped barrel wall attached to bottom of said flared opening and spaced apart there from by a circular break point circle;

c) a cone-shaped wall descending downward coincident to said circular break point circle of said cylindrically-shaped barrel wall culminating in a circular exit opening on interior surfaces;

d) an exit tube of small inside diameter directly parallel to said vertical axis and connected to said circular exit opening concluding with an exit aperture of small inside diameter;

e) wherein a controlled ratio exists between inside diameter of said exit tube of small inside diameter and wall thickness of said exit tube of small inside diameter.

11. The thin-walled deep drawn nozzle for delivering a measured quantity of viscous liquid of claim 10 wherein said cone-shaped wall descending downward from said circular breakpoint circle culminating in said circular exit opening has a convergence of approximately 10°.

12. The thin-walled deep drawn nozzle for delivering a measured quantity of viscous liquid of claim 10 wherein said flared opening inside all around provides an exterior protuberance that facilitates a means for connection to a retention device thereby enabling a nozzle to be retained in a leak-proof manner under pressure.

13. The thin-walled deep drawn nozzle for delivering a measured quantity of viscous liquid of claim 10 wherein a smooth surface lacking imperfections on said cone-shaped wall ending in said circular exit opening concluding with said exit aperture of small inside diameter presents less resistance to flow of liquid thereby reducing negative impact to discharge rate.

14. The thin-walled deep drawn nozzle for delivering a measured quantity of viscous liquid of claim 10 wherein said cone-shaped wall ending in said circular exit opening concluding with said exit aperture of small inside diameter acts to lower required pump pressure for delivery of said measured quantity of viscous liquid.

15. The thin-walled deep drawn nozzle for delivering a measured quantity of viscous liquid of claim 10 wherein said flared opening inside all around has an inside diameter of about 1.05 to about 1.15 diameters of interior dimension of said circular break point circle.

16. The thin-walled deep drawn nozzle for delivering a measured quantity of viscous liquid of claim 10 wherein a condition of increased surface area of said cone-shaped wall on a nozzle interior exposes more of a viscous liquid to a thermal source thereby enabling more efficient heat transfer in or out of a liquid passing through said nozzle.

17. The thin-walled deep drawn nozzle for delivering a measured quantity of viscous liquid of claim 10 wherein ratio of inside diameter of said exit tube of small inside diameter and wall of said exit tube of small inside diameter exceeds 7.5.

18. The thin-walled deep drawn nozzle for delivering a measured quantity of viscous liquid of claim 10 wherein said thin-walled deep drawn nozzle is made of an alloy composed of a high percentage of copper.

19. A deep drawn metal nozzle for delivering a measured quantity of viscous liquid comprising:

a) a circular exit aperture from which said viscous liquid issues that traverses upward from a second end of a small-diameter exit tube that has a first end which makes up a circular exit opening;

b) a cone-shaped wall diverges upward from said circular exit opening to a circular break point;

c) a cylindrically-shaped barrel wall coincident to inside diameter of said circular break point extends upward with an outward slant;

d) a flare wall coincident to said cylindrically-shaped barrel wall and concentric to its interior diameter climbs in elevation and bends away from said cylindrically-shaped barrel wall in a radial fashion to form an upper flared opening encircled by a horizontally arranged perimeter; and, e) a retention device fastened to said upper flared opening whereby a leak-proof connection is made for said viscous liquid to enter said deep drawn metal nozzle.

* * * * *